US007472973B2

(12) United States Patent
Huang

(10) Patent No.: US 7,472,973 B2
(45) Date of Patent: Jan. 6, 2009

(54) AUTOMATIC CLOSING MECHANISM FOR A SLIDING TRACK OF A DRAWER

(75) Inventor: Kuo-Sheng Huang, Taipei Hsien (TW)

(73) Assignee: Nan Juen International Co., Ltd. (TW)

( * ) Notice: Subject to any disclaimer, the term of this patent is extended or adjusted under 35 U.S.C. 154(b) by 127 days.

(21) Appl. No.: 11/593,154

(22) Filed: Nov. 6, 2006

(65) Prior Publication Data

US 2007/0132346 A1 Jun. 14, 2007

(30) Foreign Application Priority Data

Nov. 7, 2005 (TW) ..... 94219219 U

(51) Int. Cl.
*A47B 88/04* (2006.01)

(52) U.S. Cl. ..... 312/333; 312/319.1

(58) Field of Classification Search ..... 312/330.1, 312/333, 334.1, 334.6, 334.7, 334.8, 334.27, 312/334.32, 319.1
See application file for complete search history.

(56) References Cited

U.S. PATENT DOCUMENTS 6,340,078 B1 * 1/2002 Scheible ..... 188/166
6,953,233 B2 * 10/2005 Lam et al. ..... 312/333
7,040,725 B1 * 5/2006 Mao-Chin ..... 312/334.44
2004/0239218 A1 * 12/2004 Jurja ..... 312/333

* cited by examiner

*Primary Examiner*—James O Hansen
(74) *Attorney, Agent, or Firm*—Guice Patents PLLC

(57) ABSTRACT

An automatic closing mechanism for a slide track of a drawer according to present invention comprises a guide member, a connection member, a bendable member, and a hook stopper; the connection member is disposed on the inner wall of a furniture article and the hook stopper is disposed on the outer wall of another article in the opposite direction, and when the other object being pulled outward, the bendable member is stretched to render the guide rod contacting the outer edge of the arrow portion, the swing part rotates to press against the slant wall of the arrow portion, the swing part is retained thereon and thus points downward, and the hook stopper is disengaged and thus separated from the engagement of the swing part; and when the other object is being inserted inward, the engaged tooth of the contacts the hook stopper and the inner wall of the hook slot of the swing part at the arrow portion and is accommodated there to disengage therefrom, and thus the bendable member contracts and in turn drives the connection member and the hook stopper to move along the rectilinear portion and return to the final location.

10 Claims, 10 Drawing Sheets

AUTOMATIC CLOSING MECHANISM FOR A SLIDING TRACK OF A DRAWER

FIELD OF THE INVENTION

The present relates to a slide track of a drawer, and in particular to an automatic closing mechanism for a slide track of a drawer which may render an automatic closing of a drawer at the final stage of the closing process.

BACKGROUND OF THE INVENTION

Slide track is a familiar object in daily life. Drawer, for example, may be pulled to extend its length and pushed to return to its original position. Consequently, drawer has been widely seen in daily life.

The aforementioned slide track of a drawer should not only be able to be pulled out but also be pushed in through a labor-saving means. Consequently, the industry has been developing various types of designs for the automatic closing or returning mechanism, such that users need not to push the drawer to the end when closing the drawer; rather, the drawer can be sliding through the slide track to reach the closed position.

U.S. Pat. No. 5,207,781, for example, discloses a closing device for moving the drawer to a fully inserted position within the furniture body. The device is mounted between the furniture body and a drawer, comprising a rail member, formed by assembling a tiltable member, a guide track, and a spring, disposed on the inner wall of a furniture body and a pin member mounted on the outer wall of the drawer. The guide track comprises a rectilinear portion and an arcuate portion such that two guide rods formed from the bottom of the tiltable member can be adapted to be mounted thereupon and slide back and forth. The spring is attached with the tiltable member and the rail member on its either end. The tiltable member is disposed with a catch slot to accommodate the pin member and is further fabricated to form a beveled edge.

When the drawer is being pulled outward, the tiltable member is pulled by the pin member to move outward along the guide track and in the mean time stretch the spring. However, the tiltable member tilts when it moves to the arcuate portion of the guide track and thus the pin member will release its engagement with the tiltable member through the beveled edge, such that the drawer can be pulled outward continuously. At the point, the tiltable member is resided at the arcuate portion to prepare for the pin member to enter and reside in the catch slot through the beveled edge. When an external force is applied to the two guide rods of the tiltable member to enter the rectilinear portion of the guide track, the spring is contracted to pull the tiltable member and the pin member to return their original positions, such that the drawer can return to its closed position and close the opening of the furniture body.

Although the aforementioned invention may achieve the expected automatic closing function, some drawbacks are found and described as follows:

(1) Since the rectilinear portion and the arcuate portion of the guide track according to the aforementioned invention is L-shaped, when the tiltable member releases the engagement with the pin member, the two guide rods reside at the rectilinear portion and the arcuate portion, respectively, and the spring will exert a larger pulling force on the guide rod at the arcuate portion, such that the guide rod often fractures as a result and thus the slide track is damaged.

(2) Since there is an elevational difference between the rectilinear portion and the arcuate portion of the guide track according to the aforementioned invention, the position of the tiltable member at the arcuate portion relative to that of the tiltable member moving at the rectilinear portion will change, and thus the straight stretching of the spring becomes slant stretching, such that the returning function is negatively affected.

(3) Furthermore, to prevent the tiltable member and the pin member from abnormal disengagement in the aforementioned invention, the front of the tiltable member is protrudingly disposed with a bendable catch, such that when tiltable member moves away from its expected position, the pin member is thus pushed inward to squeeze and cross over the bendable catch. However, the vertical squeeze often causes the bendable catch to fracture accidentally, preventing the tiltable member and the pin member from engaging again and thus losing the automatic returning function.

SUMMARY OF THE INVENTION

To meet such a demand, the applicant having a long time experience in designing, production, and marketing of slide tracks proposes the present invention, an automatic closing mechanism for a slide track of a drawer, as a result of numerous trials and experiments.

An object of the present invention is to provide an automatic closing mechanism for a slide track of a drawer, comprising a guide member having a guide track formed on a base and the guide track having a rectilinear portion and an arrow portion interlinked with the front of the rectilinear portion; a connection member having a driven slide and a swing part pivotedly connected on the front of the driven slide, wherein the bottoms of the driven slide and the swing part extend to form at least a guide tenon and a rectangle guide rod, respectively, to be adapted to the guide slot, and one side of the swing disposed with a hook slot; a bendable member whose both ends are connected with the driven slide and an article of furniture, respectively; a hook stopper extending to form at least an engaged tooth corresponding to the swing part; such that the connection member is disposed on the inner wall of a furniture article and the hook stopper is disposed on the outer wall of another article in the opposite direction, and when the other object being pulled outward, the bendable member is stretched to render the guide rod contacting the outer edge of the arrow portion, the swing part rotates to press against the slant wall of the arrow portion, the swing part is retained thereon and thus points downward, and the hook stopper is disengaged and thus separated from the engagement of the swing part; and when the other object is being inserted inward, the engaged tooth of the contacts the hook stopper and the inner wall of the hook slot of the swing part at the arrow portion and is accommodated there to disengage therefrom, and thus the bendable member contracts and in turn drives the connection member and the hook stopper to move along the rectilinear portion and return to the final location.

Another object of the present invention is to provide an automatic closing mechanism for a slide track of a drawer, wherein the article is the inner wall of a furniture body or a fixed track, and the other article is the outer wall of a furniture body or a moving track, wherein a plurality of catch slots are disposed at appropriate positions at the base such that the base may be riveted by the clamp pieces disposed on the furniture body or the fixed track, furthermore the guide member, the connection member, and the bendable member are mounted onto the fixed track, the hook stopper is mounted onto the moving track, and an intermediate track is disposed between the fixed track and the moving track.

Yet another object of the present invention is to provide an automatic closing mechanism for a slide track of a drawer, wherein the hook slot is disposed with a hook head and a hook end on its front and rear, respectively, the hook stopper has two protruding engaged teeth corresponding to the hook slot so as to form a close engagement, and furthermore when the hook stopper moves inward and its inner engaged tooth contacts the hook head downward to compress the bendable section formed by a fork slot in the rectilinear portion, the rear engaged tooth, or together with front engaged tooth, is thus favorably to be engaged in the hook slot.

Still yet another object of the present invention is to provide an automatic closing mechanism for a slide track of a drawer, further comprising a buffer member whose hydraulic cylinder is clamped in the arc concave sections formed between the upper wall and the wall of the base, wherein the front of the cylinder extends to form an extension rod connected with the driven slide, and the front end of the extension rod is disposed with an engaged tenon to be engaged with the connection slot.

Still another object of the present invention is to provide an automatic closing mechanism for a slide track of a drawer, wherein the base is longitudinally disposed with a plurality of catch tenons to be fastened with the hook slot of an upper cover, such that the top of the base is sealed and furthermore, the bendable member is a spring, which is accommodated in and laid through the spring slot formed by inner wall of the upper wall and the base.

BRIEF DESCRIPTION OF THE DRAWINGS

The present invention can be more fully understood by reference to the following description and accompanying drawings, in which.

DETAILED DESCRIPTION OF THE INVENTION

Figure 1:
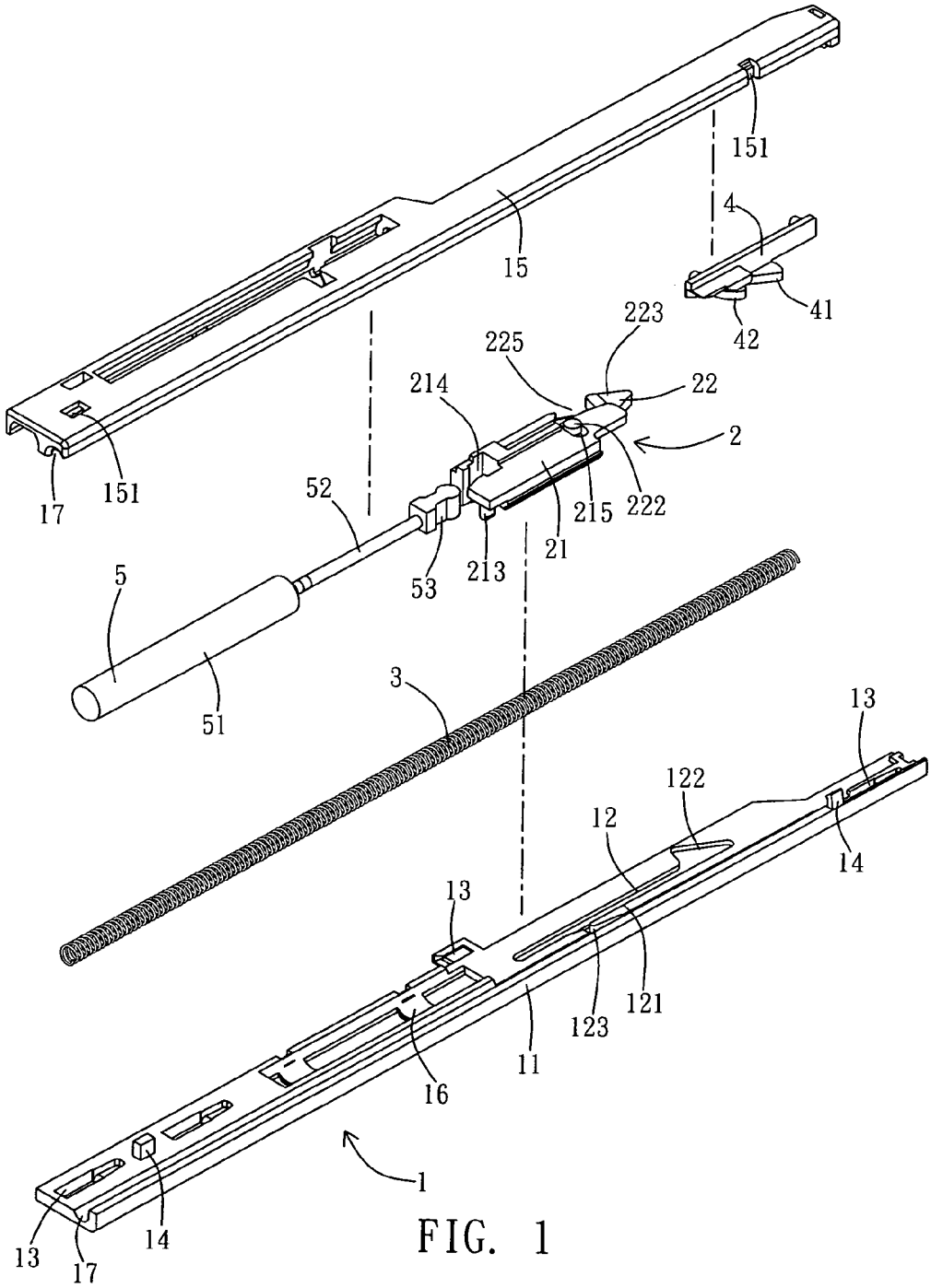
FIG. 1 schematically illustrates an exploded perspective view of the automatic closing mechanism for a slide track of a drawer according to the present invention.
Figure 2:
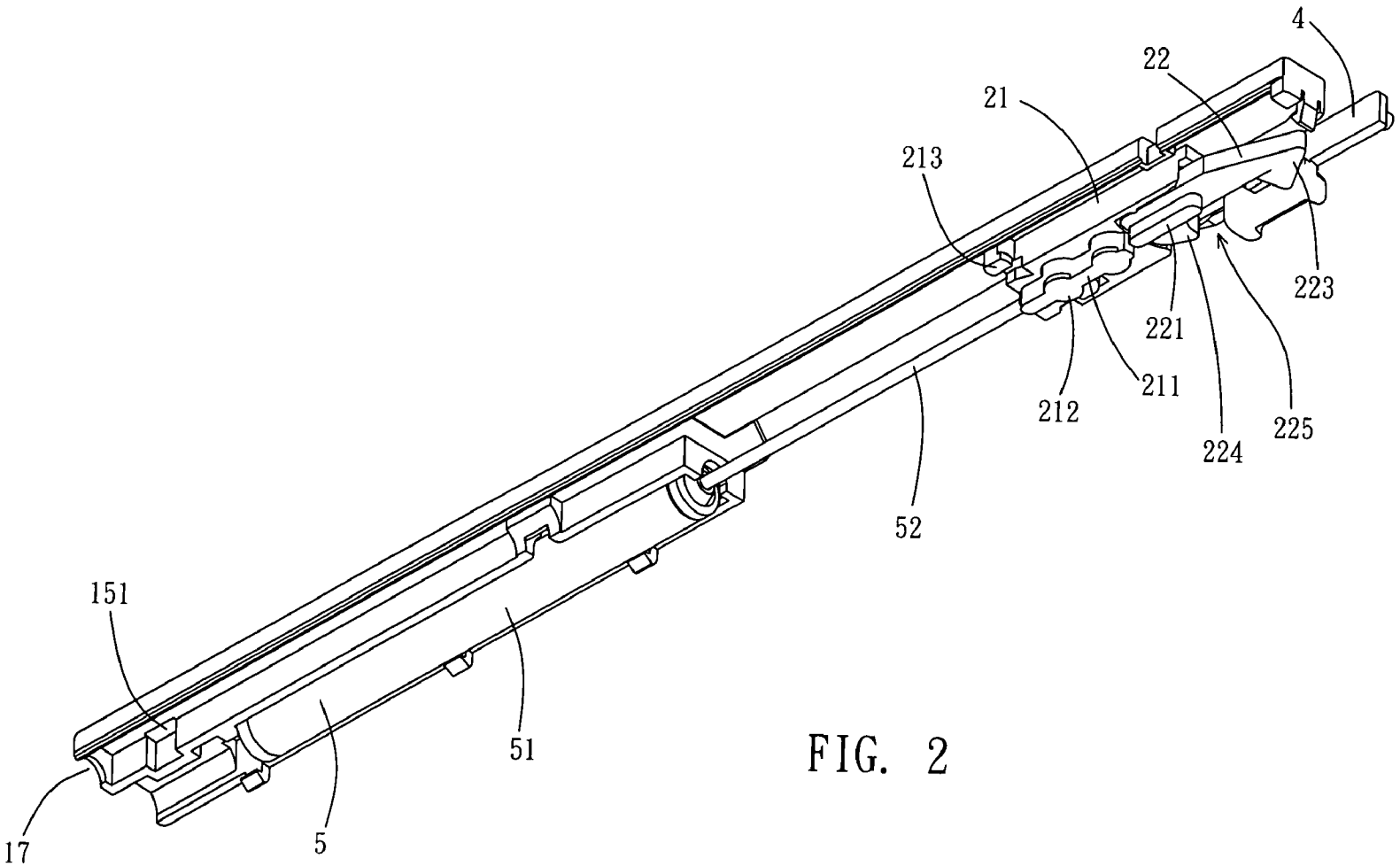
FIG. 2 schematically illustrates a perspective bottom view of the connection member according to the present invention.
Figure 3A:
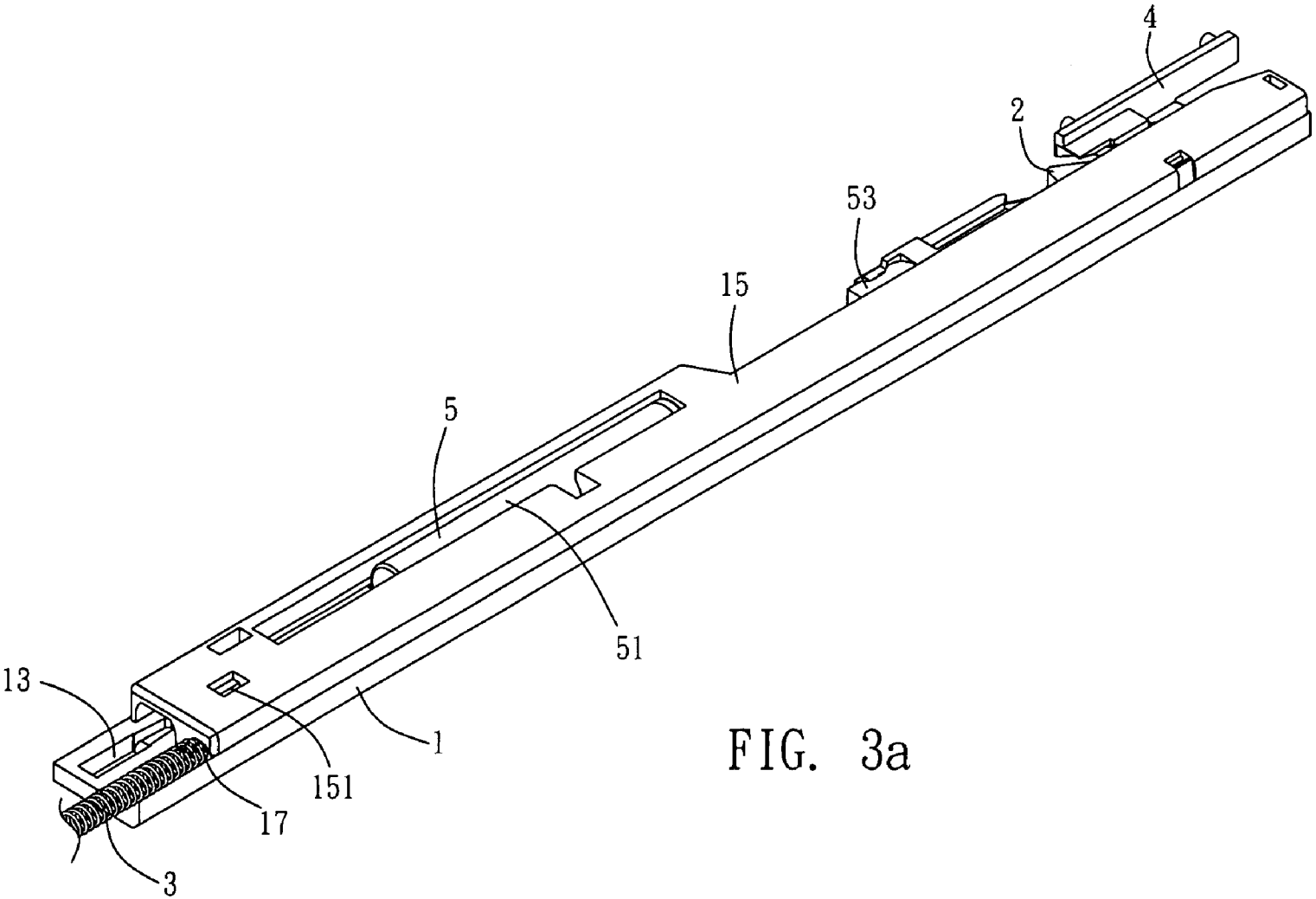
FIGS. 3*a* and 3*b* schematically illustrate perspective assembly views of the automatic closing mechanism for a slide track of a drawer from two different view angles according to the present invention.
Figure 3B:
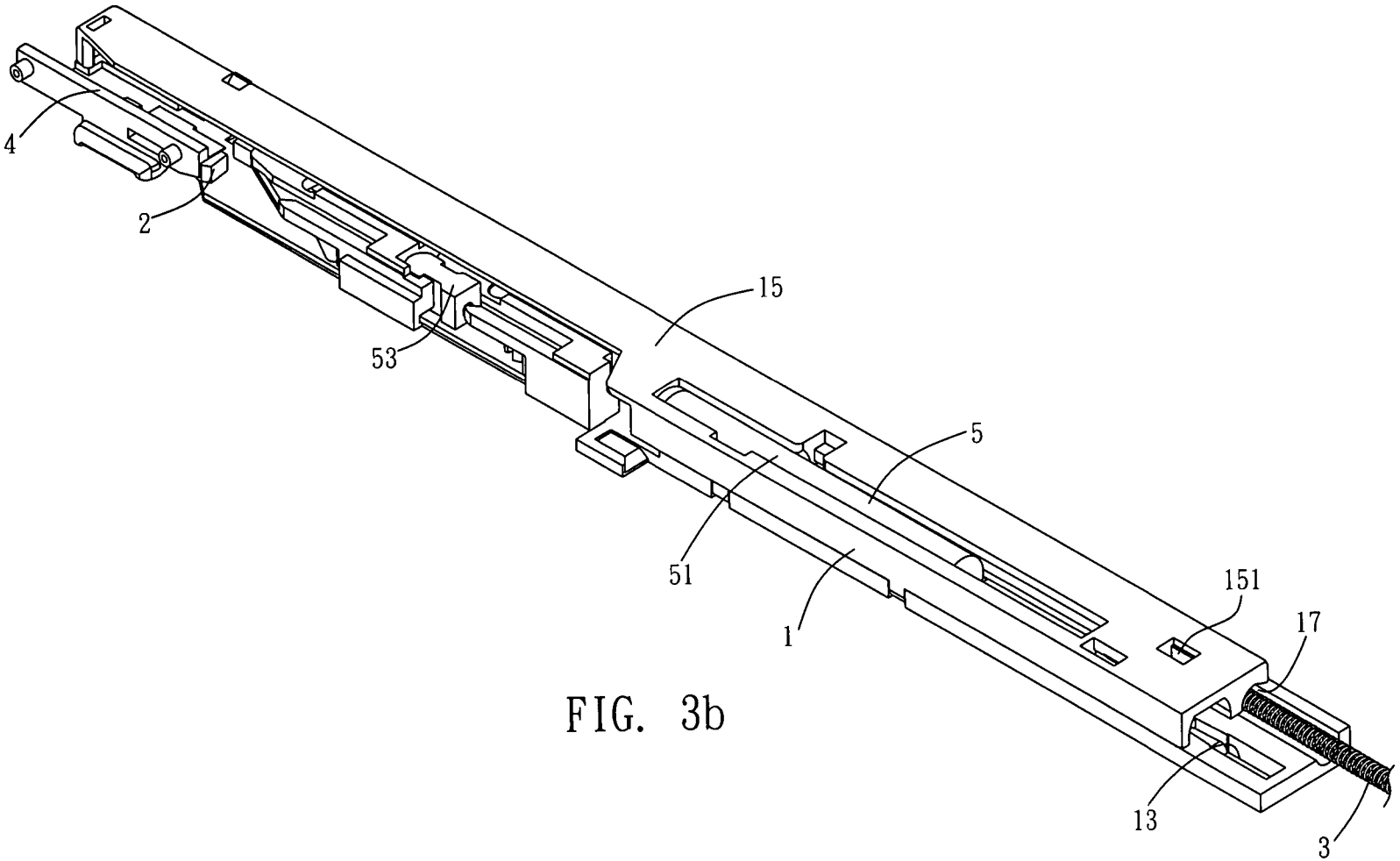

With reference to FIGS. 1 to 3*b*, the automatic closing mechanism for slide track of a drawer according to present invention comprises a guide member 1, a connection member 2, a bendable member 3, and a hook stopper 4, wherein the automatic closing mechanism is used in an article of furniture having furniture components including a furniture body and a drawer slidable in opposite directions into and out of the furniture body, for moving the drawer to a fully inserted position within the furniture body.

The connection member 1 is disposed on the inner wall of the furniture body, a fixed track 61 of a slide track 6 for example, so as to the connection member 1 described later to be slidable thereupon. With reference to the figures, the guide member 1 has a guide slot 12 formed on a rectangular base 11, wherein the guide slot 12 comprises a rectilinear portion 121 and an arrow portion 122 interlinked with the front of the rectilinear portion 121. To fasten the base 11 onto the fixed track 61, a plurality of catch slots 13 are disposed at appropriate positions such that the clamp pieces of the fixed track 61 may be riveted with the base 11, the base may be riveted by the clamp pieces disposed on the furniture body or the fixed track which is a conventional art and will not be discussed furthermore. Also, the base 11 is longitudinally disposed with a plurality of catch tenons 14 to be fastened with the hook slot 151 of an upper cover 15, such that the top of the base 11 is sealed and a buffer member 5 is clamped therebetween. Consequently, the inner wall of the upper cover 15 and the base 11 are both provided with an arc concave section 16, respectively, for accommodation and retaining of the buffer member 5 described later. Further, the inner wall of the upper wall 15 and the base 11 is concavely disposed with a spring slot 17 for the accommodation and passing of the bendable member 3.

The connection member 2 comprises a driven slide 21 and a swing part 22 pivotedly connected on the front of the driven slide 21. The bottoms of the driven slide 21 and the swing part 22 extend to form at least a guide tenon 211 and a rectangle guide rod 221, respectively, to be adapted to the guide slot 12, such that the connection member 2 may be sliding within the guide slot 12 back and forth. To prevent the driven slide 21 from coming out of the guide slot 12, the bottom of each guide tenon 211 horizontally extends to form a stop 212. Also, the end of the driven slide 21 is disposed with a connection tenon 213 and a connection slot 214, respectively, to be connected with the bendable member 3 and the extension rod 52 of the buffer member 5 described later. Furthermore, the front end of the driven slide 21 is fabricated to form an axial hole 215 to be axially connected with the axial tenon 222 of the swing part 22. Also, two ends of one side of the swing part 22 is disposed with a hook head 223 and a hook end 224, respectively, to form a hook slot 225 therebetween.

Both ends of the bendable member 3 is connected with a driven slide 21 and the furniture body or the fixed track 61, respectively, such that the driven slide 21 may resiliently stretch or contract, wherein the bendable member 3 is preferably is a spring.

The hook stopper 4 is disposed on the outer wall of a drawer, a moving track 62 of the slide track 6, such that when the hook stopper 4 is resided on the rectilinear portion 121 of the guide slot 12, two engaged teeth 41 and 42 are engaged with the hook slot 225 of the swing part 22; when the hook stopper 4 is resided on the arrow portion 122 of the guide slot 12, the two engaged teeth 41 and 42 are disengaged with the hook slot 225 of the swing part 22. The relative movement of the connection member 2 and the hook stopper 4 will be described later.

The buffer member 5 comprises a hydraulic cylinder accommodated and retained in the guide member 1 and its front extension rod 52 is mounted onto the driven slide 21 to provide the buffering function and thus prevent the automatic closing of a drawer from damaging the furniture body. With reference to the figures, the front end of the extension rod 52 is disposed with an engaged tenon 53 to be engaged with the connection slot 214.

Figure 4:
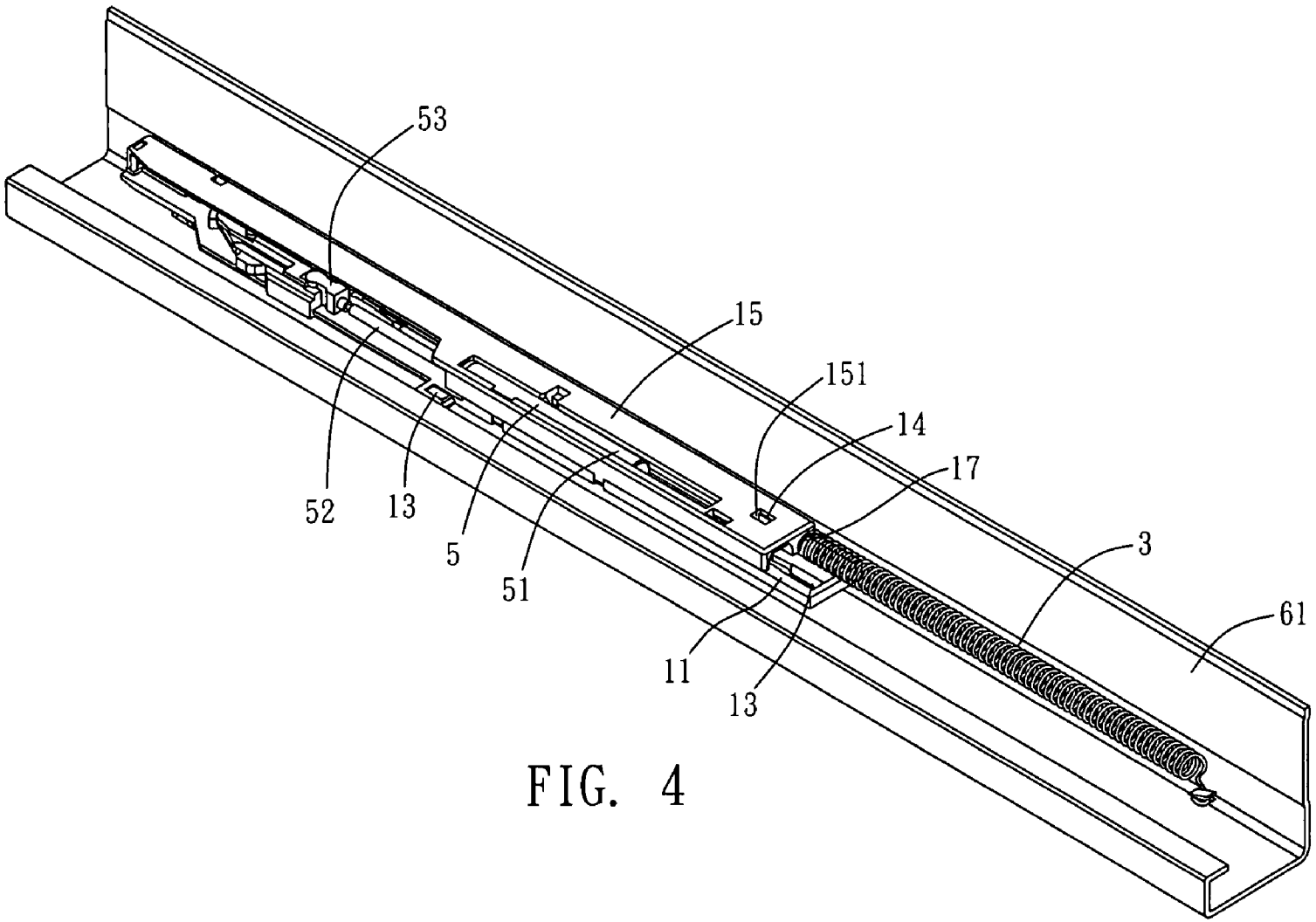
FIG. 4 schematically illustrates a perspective view of the guide member, the connection member, and the bendable member being assembled in the fixed track according to the present invention.
Figure 5:
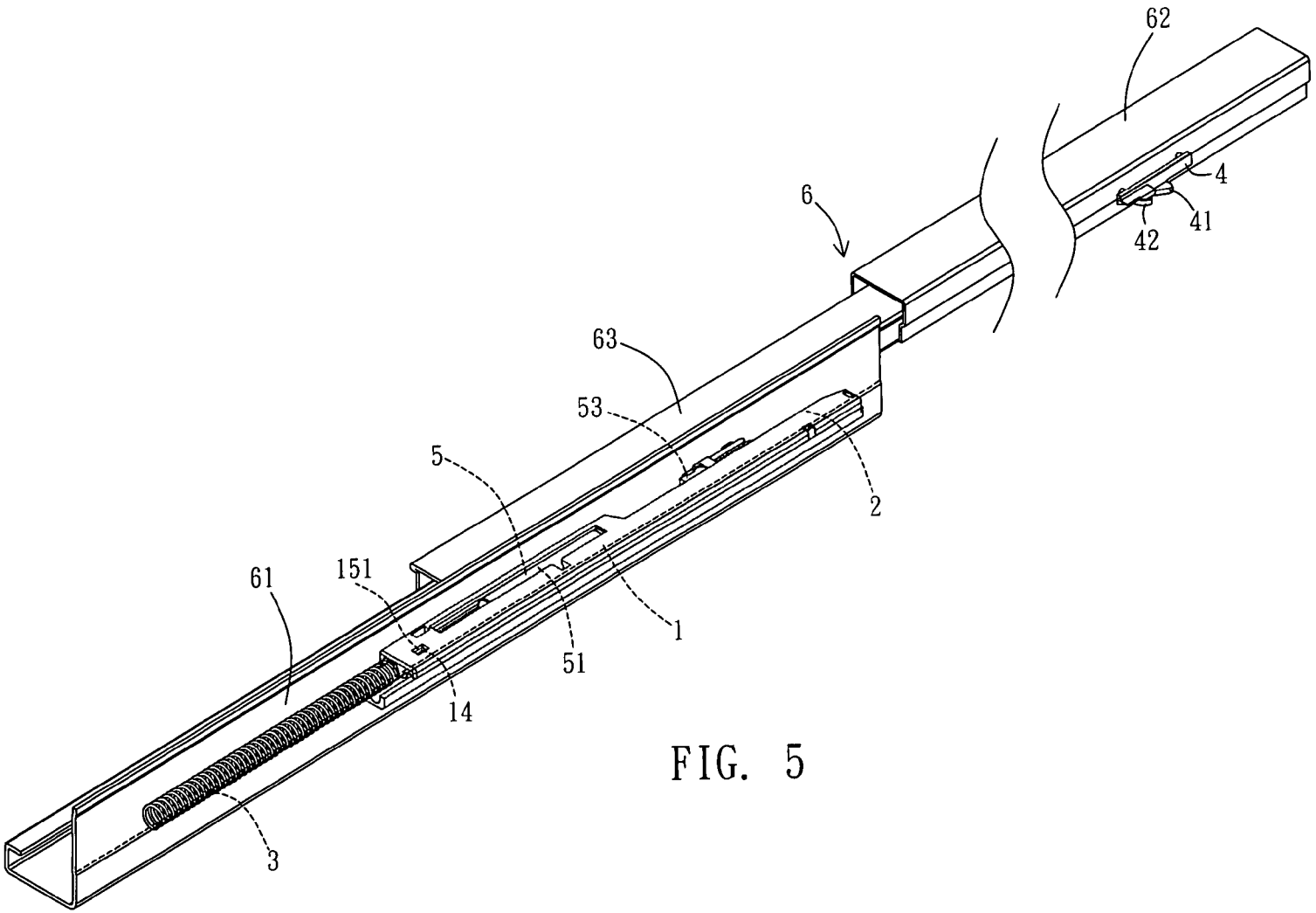
FIG. 5 schematically illustrates a perspective view of the automatic closing mechanism being assembled in a multiple slide track of a drawer.

With reference to FIGS. 4 and 5, the automatic closing mechanism according to the present invention is assembled in a multiple slide track of a drawer 6, wherein the guide member 1, the connection member 2, and the bendable member 3 are mounted onto the fixed track 61, the hook stopper 4 is mounted onto the moving track 62, and an intermediate track 42 is disposed between the fixed track 61 and the moving track 62.

Figure 6A:
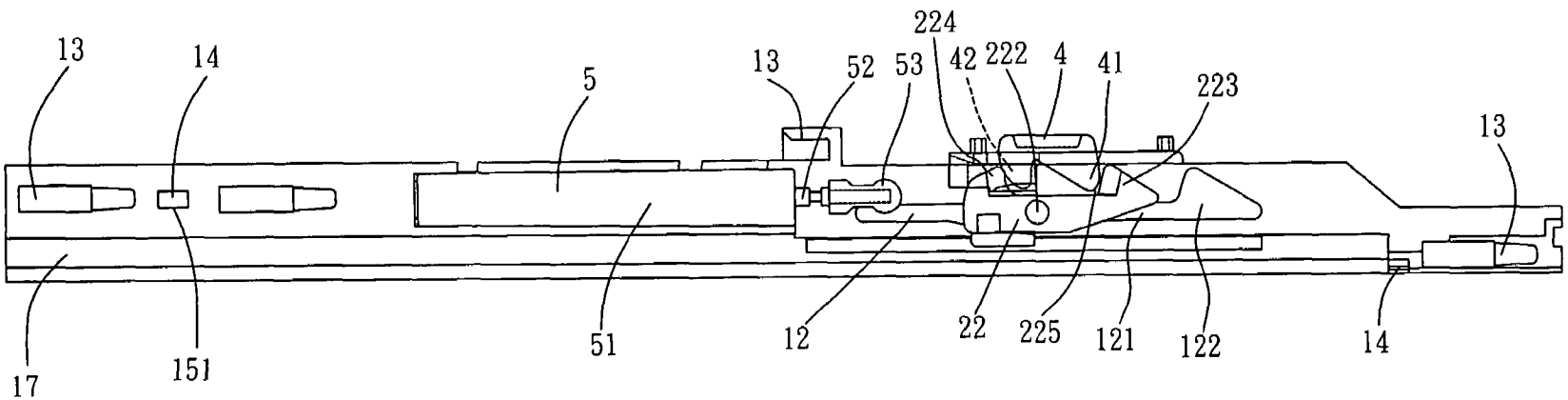
FIGS. 6*a* to 6*c* schematically illustrate the operational flowcharts of the guide member, the connection member, and the hook stopper at a normal condition according to the present invention.
Figure 6B:
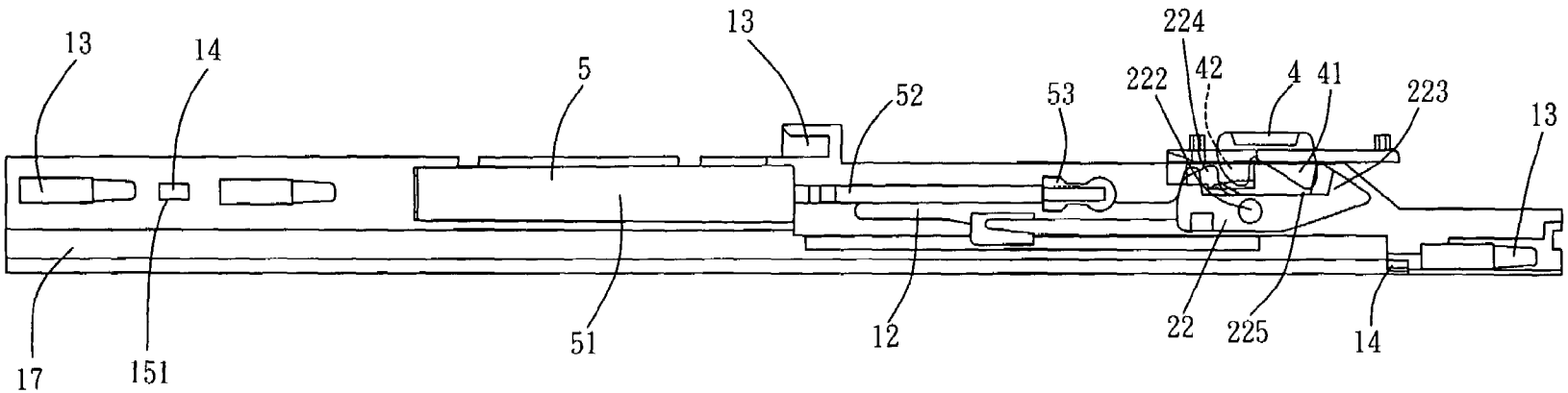
Figure 6C:
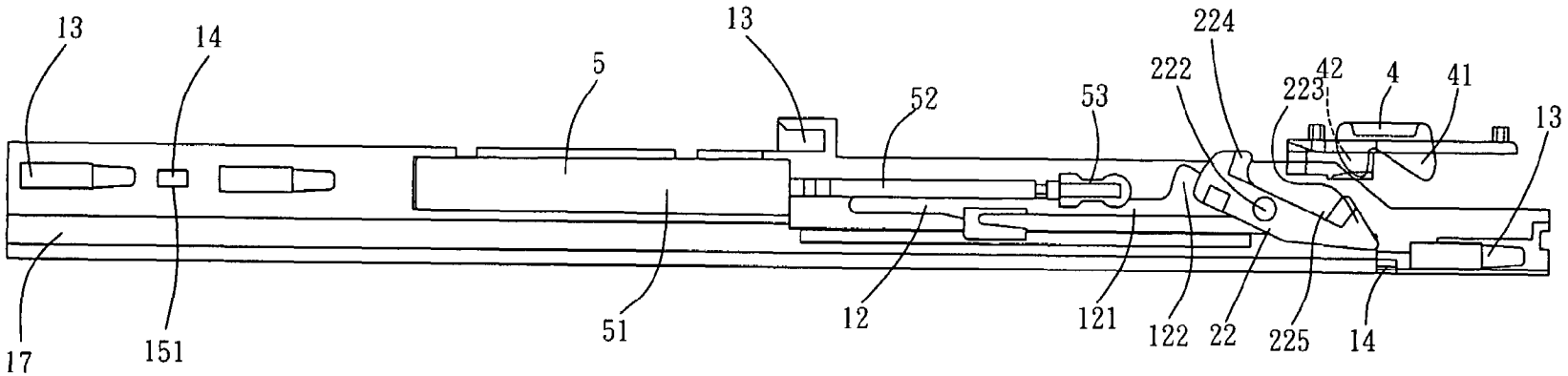

With reference to FIGS. 6*a* to 6*c*, when the drawer is being pulled out, the swing part 22 is resided at the rectilinear portion 121, and the two engaged teeth 41 and 42 of the hook stopper 4 are engaged in the hook slot 225 of the swing part 22 (as shown in FIG. 6*a*) to drive the swing part 22 and the driven slide 21 to move outward with the bendable member 3 being extended. When the swing part 22 and the hook stopper 4 are moved to the area between the rectilinear portion 121 and the arrow portion 122, the two engaged teeth 41 and 42 of the hook stopper 4 are still engaged in the hook slot 225 of the swing part 22 (as shown in FIG. 6*b*). With the drawer being pulled out continuously, the guide rod 211 on the bottom of the swing part 22 contacts the outer edge of the arrow portion 122 and is thus stopped moving forward. Then, the swing part 22 is driven to rotate to press against the slant wall of the arrow portion 122, and subsequently the swing part 22 is retained thereon and thus points downward. Consequently, the hook stopper 4 is disengaged and thus separated from the engagement of the swing part 22, such that the drawer may be pulled outward further (as shown in FIG. 6*c*). Alternatively, when the drawer is being inserted in, the swing part 22 is resided at the arrow portion 122, while the rear engaged tooth 42 contacts the hook end 224 to disengage. Therefore, the swing part 3 swings upward to render the two engaged teeth 41 and 42 closely engaged in the hook slot 225. Consequently, the bendable member 3 contracts and thus drives the connection member 2 and the hook stopper 4 to move along the rectilinear portion 121 and return to the final location, so as to achieve the expected function of automatic closing for the drawer.

Figure 7:
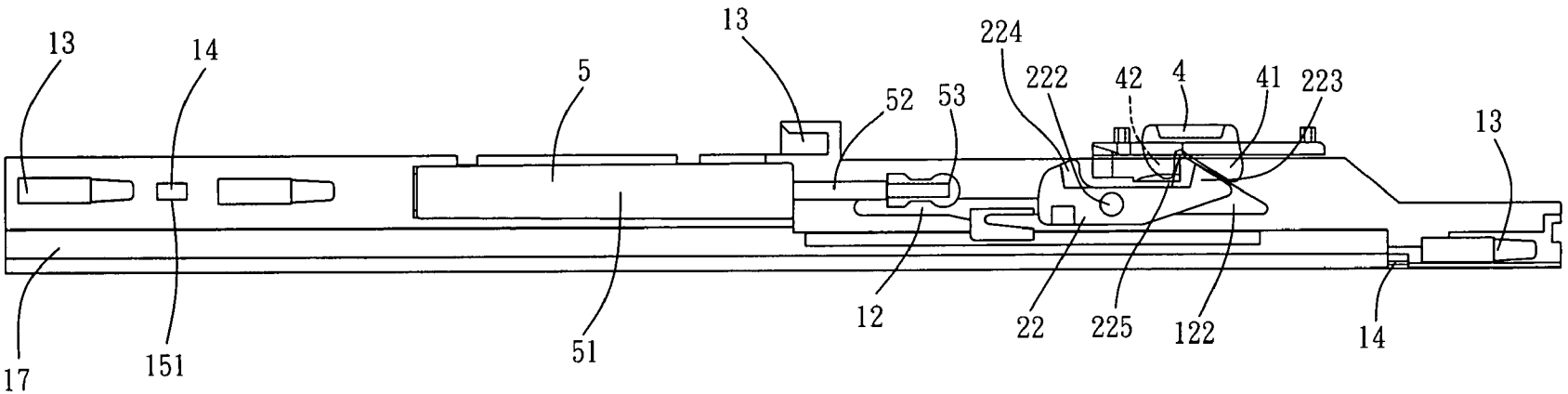
FIG. 7 schematically illustrates the operational flowcharts of the guide member, the connection member, and the hook stopper at an abnormal condition according to the present invention.

With reference to FIG. 7, the abnormal condition of the guide member and the hook stopper is disclosed. For example, the guide member 1 does not stay at the arrow portion 122 for the return of the hook stopper 4; rather it is resided at the rectilinear portion 121. To correct the fault, the hook stopper 4 is inserted further inward until the rear engaged tooth 42 of the hook stopper 4 contacts and presses against the hook head 223 downward to compress the bendable section formed by a fork slot 123 in the rectilinear portion 121, such that at least the rear engaged tooth 42, or together with front engaged tooth 41, is thus favorably to be engaged in the hook slot 225. Then, the aforementioned pulling procedure is followed to correct the fault.

With the implementation of the present invention, there are many advantages described as follows:

(1) The rectilinear portion and the arrow portion of the guide slot according to the present invention is not a L-shaped track, and it is basically a rectilinear arrow track. Also, the guide rod on the bottom of the swing part is a long slender rod with a high strength, such that its fracture is unlikely to occur.

(2) The disengagement of the connection member and the hook stopper according to the present invention is achieved by engaging the swing part in the arrow portion. Since driven slide will not be deflected, the bendable member still retain its rectilinearity, instead of slanting, such that no inclined component of force exists to affect the automatic closing of the hook stopper. Also, the relative motion of the retained state and the guide rails remains unchanged as rectilinear.

(3) The hook stopper according to the present invention is designed to have two engaged teeth, which can have larger allowance, 10-12 mm for example. This large allowance can accommodate the deflection resulted from the installation of drawer slides. Also, if the guide member and the hook stopper is in an abnormal condition, it can be corrected by rendering the rear engaged tooth of the hook stopper to contact and downward press against the hook head resiliently, such that at least the rear engaged tooth, or together with front engaged tooth, is thus favorably to be engaged in the hook slot, which is indeed a breakthrough to conventional art.

While the invention has been described with reference to the a preferred embodiment thereof, it is to be understood that modifications or variations may be easily made without departing from the spirit of this invention, which is defined by the appended claims.

What is claimed is:

1. An automatic closing mechanism for a slide track of a drawer, comprising:

a guide member having a guide slot formed on a base and the guide slot having a rectilinear portion and an arrow portion interlinked with a front of the rectilinear portion;

a connection member having a driven slide and a swing part pivotedly connected on a front of the driven slide, a guide tenon is located on a bottom of the driven slide and a rectangle guide rod is located on a bottom of the swing part, the guide tenon and the rectangle guide rod are inserted into the guide slot, and one side of the swing part has a hook slot;

a bendable member has a first end connected with the driven slide and a second end connected to a first structure; and a hook stopper extending to form at least an engaged tooth corresponding to the swing part;

wherein the connection member is located on an inner wall of the first structure and the hook stopper is located on a second structure in an opposite direction;

wherein, when the second structure is pulled outwardly, the bendable member is stretched to render the guide rod contacting an outer edge of the arrow portion, the swing part rotates to press against a slant wall of the arrow portion, the swing part is retained thereon and thus points downward, and the hook stopper is disengaged and thus separated from the engagement of the swing part; and when the second structure is being inserted inward, the engaged tooth of the hook stopper contacts the inner wall of the hook slot of the swing part at the arrow portion and is accommodated there to disengage therefrom, and thus the bendable member contracts and in turn drives the connection member and the hook stopper to move along the rectilinear portion and return to a final location.

2. Automatic closing mechanism according to claim 1, wherein the first structure is selected from a group consisting of an inner wall of a first furniture body and a fixed track, and the second structure is selected from a group consisting of an outer wall of a second furniture body or a moving track.

3. Automatic closing mechanism according to claim 2, wherein a plurality of catch slots are disposed at predetermined positions at the base, the base is riveted by clamp pieces located on a structure selected from the first furniture body, the second furniture body, and the fixed track.

4. Automatic closing mechanism according to claim 2, wherein the guide member, the connection member, and the bendable member are mounted onto the fixed track, the hook stopper is mounted onto the moving track, and an intermediate track is disposed between the fixed track and the moving track.

5. Automatic closing mechanism according to claim 1, wherein the swing part is disposed with a hook head and a hook end on a front and rear thereof, the at least an engaged tooth of the hook stopper has two protruding engaged teeth corresponding to the swinging part so as to form a close engagement.

6. Automatic closing mechanism according to claim 5, wherein, when the hook stopper moves inward and an inner engaged tooth of the two protruding engaged teeth contacts the hook head to compress the bendable section formed by a fork slot in the rectilinear portion, at least one of the two protruding engaged teeth is located in the hook slot.

7. Automatic closing mechanism according to claim 1, wherein the base is longitudinally disposed with a plurality of catch tenons to be fastened with the hook slot of an upper cover.

8. Automatic closing mechanism according to claim 1, wherein a buffer member whose hydraulic cylinder is clamped between arc concave sections formed on an upper cover and a wall of the base, wherein a front of the cylinder extends to form an extension rod connected with the driven slide.

9. Automatic closing mechanism according to claim 8, wherein a front end of the extension rod is connected to an engaged tenon to be engaged with the connection slot.

10. Automatic closing mechanism according to claim 1, wherein the bendable member is a spring located in a spring slot formed by an upper cover and the base.

* * * * *